US005215068A

United States Patent [19]

Kato

[11] Patent Number: 5,215,068

[45] Date of Patent: Jun. 1, 1993

[54] TWO CYCLE INTERNAL COMBUSTION ENGINE WITH MULTPLE CYLINDER FUEL INJECTION

[75] Inventor: Masahiko Kato, Shizuoka, Japan

[73] Assignee: Yamaha Industries Co., Ltd., Japan

[21] Appl. No.: 910,557

[22] Filed: Jul. 8, 1992

[30] Foreign Application Priority Data

Jul. 8, 1991 [JP] Japan ..... 3-193474

[51] Int. Cl.[5] ..... F02D 41/04; F02D 41/22

[52] U.S. Cl. ..... 123/676; 123/73 R; 123/488; 123/690

[58] Field of Search ..... 123/73 R, 73 A, 73 B, 123/73 C, 478, 479, 488, 494, 676, 688, 690; 73/118.2

[56] References Cited

U.S. PATENT DOCUMENTS 4,269,156 5/1981 Drellishak ..... 123/676 X
4,461,260 7/1984 Nonaka et al. ..... 123/478
4,509,485 4/1985 Hasegawa ..... 123/676
4,643,147 2/1987 Staerzl ..... 123/676
4,683,857 8/1987 Yasuoka ..... 123/676
4,823,755 4/1989 Hirose et al. ..... 123/486 X
4,987,773 1/1991 Stiles et al. ..... 123/478 X

*Primary Examiner*—Tony M. Argenbright
*Attorney, Agent, or Firm*—Bacon & Thomas

[57] ABSTRACT

In a fuel injected internal combustion engine, the fuel injection is based on computation rather than direct measurement of air intake. To correct for air intake volume changes caused by external factors, a pressure sensor detects the pressure inside the exhaust manifold and, based on this detected value, a correction is made either to the computed value for air intake, directly to the computation of the amount of fuel to be injected, or both. The corrected air intake volume and the corrected fuel injection amount are then used as the basis for ECU control of the time power is applied to the fuel injector.

21 Claims, 7 Drawing Sheets $Q_1 < Q_2 < \cdots < Q_8$

FIG. 9

| $Q_{Ai}$ \ $P_i$ | $P_1$ | $P_2$ | $P_3 \cdots$ | $P_j$ | $P_M$ |
|---|---|---|---|---|---|
| $Q_{A1}$ | $K_{11}$ | $K_{12}$ | $K_{13} \cdots$ | $K_{1j}$ | $K_{1M}$ |
| $Q_{A2}$ | $K_{21}$ | $K_{22}$ | $K_{23} \cdots$ | $K_{2j}$ | $K_{2H}$ |
| $Q_{A3}$ | $K_{31}$ | $K_{32}$ | $K_{33} \cdots$ | $K_{3j}$ | $K_{3M}$ |
| $\vdots$ | $\vdots$ | $\vdots$ | $\vdots$ | $\vdots$ | |
| $Q_{Ai}$ | $K_{i1}$ | $K_{i2}$ | $K_{i3} \cdots$ | $K_{ij}$ | $K_{iM}$ |
| $\vdots$ | $\vdots$ | $\vdots$ | $\vdots$ | $\vdots$ | |
| $Q_{AN}$ | $K_{N1}$ | $K_{N2}$ | $K_{N3}$ | $K_{Nj}$ | $K_{NM}$ |

TWO CYCLE INTERNAL COMBUSTION ENGINE WITH MULTPLE CYLINDER FUEL INJECTION

BACKGROUND OF THE INVENTION

1. Field of the Invention

This invention concerns a fuel injected internal combustion engine in which the air intake volume is computed and the amount of fuel injected is based on this computation of the air intake volume.

2. Description of Related Art

It is known to detect the amount of air intake in order to control the amount of fuel injected in fuel injected internal combustion engines. The method used in the past to detect the amount of air intake was to employ an air flow meter, but this increased the air intake resistance and caused changes in the operating characteristics of the engine. More recently, the amount of air intake has been computed using variations in the pressure inside the crank chamber.

An example of the use of computation to determine the air intake volume appears in Japan Patent Hei 2-4785 (1990). In this example, the difference between the crank chamber pressure just prior to the opening of the scavenging port (SPO) and the crank chamber pressure when the scavenging port is closed (SPC) during normal engine operation are used to determine the air intake volume. Alternatively, by way of example, the computation can also be based on detection of the throttle opening and the engine speed.

A problem with the above-described air intake computation methods is that, in marine engines and some other internal combustion engines, external factors such as speed and load changes cause the air intake volume to change compared to the degree to which the throttle is open and the engine speed under other operating conditions. This results in an error between the computed value for air intake volume and the actual volume.

Since the above mentioned prior art fuel injection systems use a computed value for air intake volume as the basis for determining fuel injection, any error between the computed and actual values for the air intake leads to unavoidable degradations in engine performance.

SUMMARY OF THE INVENTION

A principal objective of the invention is to provide a fuel injected internal combustion engine with excellent performance characteristics which overcomes the drawbacks of conventional fuel injection systems, even though it bases fuel injection on a computed value for air intake, by detecting a pressure in the exhaust system in order to correct for errors in the air intake value computation resulting from such external factors as speed and load changes, exhaust system configuration changes, atmospheric pressure changes, and so forth.

In order to achieve this objective, the invention provides a fuel injected internal combustion engine having an air intake computation means which computes the air intake volume, and a fuel injection control means which controls the amount of fuel injected based on the computed air intake volume, the fuel injected internal combustion engine being equipped with a detection means for detecting the pressure in the exhaust system, and a correction means which, based on the detected pressure value, corrects either the computed air intake value, the amount of fuel injection directly, or both. The air intake volume may be computed by a variety of methods, the advantages achieved by the present invention resulting from the inclusion of an exhaust pressure detection means and a correction means.

When external factors such as speed/load changes, exhaust system configuration changes, or atmospheric pressure changes develop to cause a discrepancy between the computed amount of air intake and the actual amount, the preferred system corrects either the computed air intake volume or the amount of fuel injection, or both, based on the detection of changes in back pressure or vibrations in the exhaust system, and performs a computation based on the corrections to provide an internal combustion fuel injected engine with good operating characteristics.

BRIEF DESCRIPTION OF THE DRAWINGS

FIG. 9 is a three dimensional map of the relationship shown in FIG. 5.

DETAILED DESCRIPTION OF THE PREFERRED EMBODIMENTS

Figure 1:
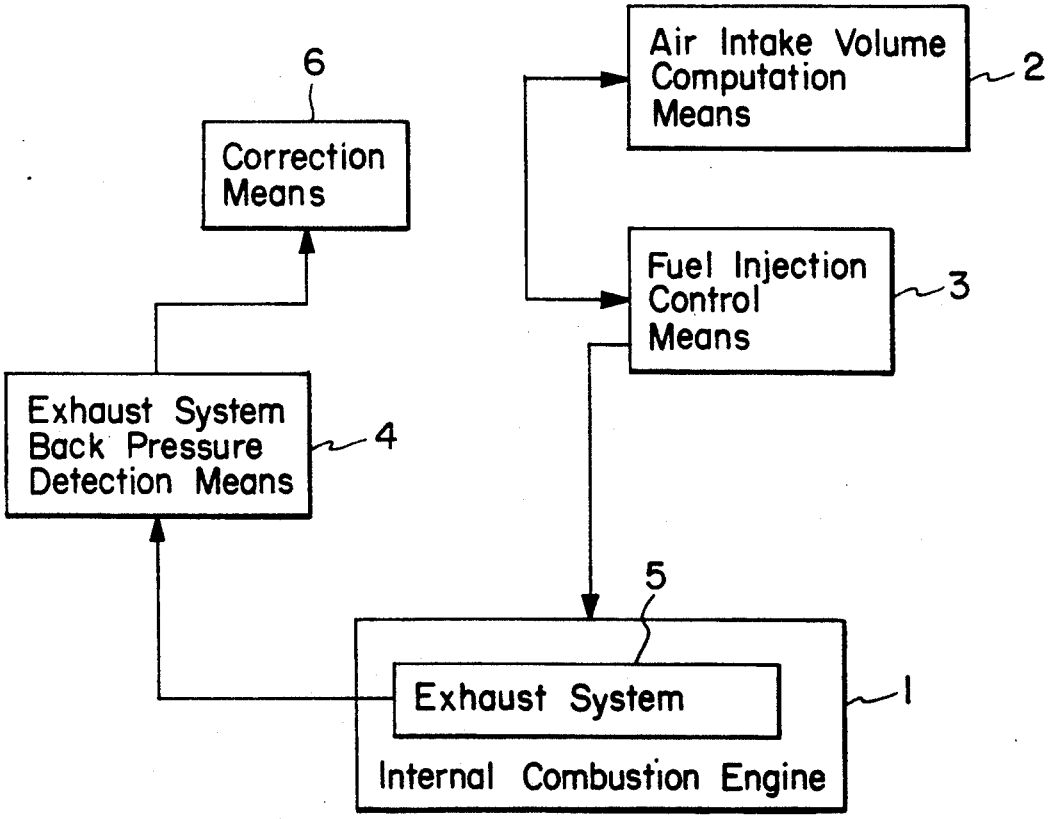
FIG. 1 is a block diagram of a fuel injection system constructed in accordance with the principles of a preferred embodiment of the invention.

As shown in FIG. 1, the preferred fuel injection system for an internal combustion engine 1 includes an air intake computation means 2 which computes the air intake volume, a fuel injection control means 3 for controlling the amount of fuel injected based on the computed air intake volume, a detection means 4 for detecting the pressure in the exhaust system 5, and a correction means 6 which, based on the detected pressure value, corrects either the computed air intake value or the amount of fuel injection, or both.

Figure 2:
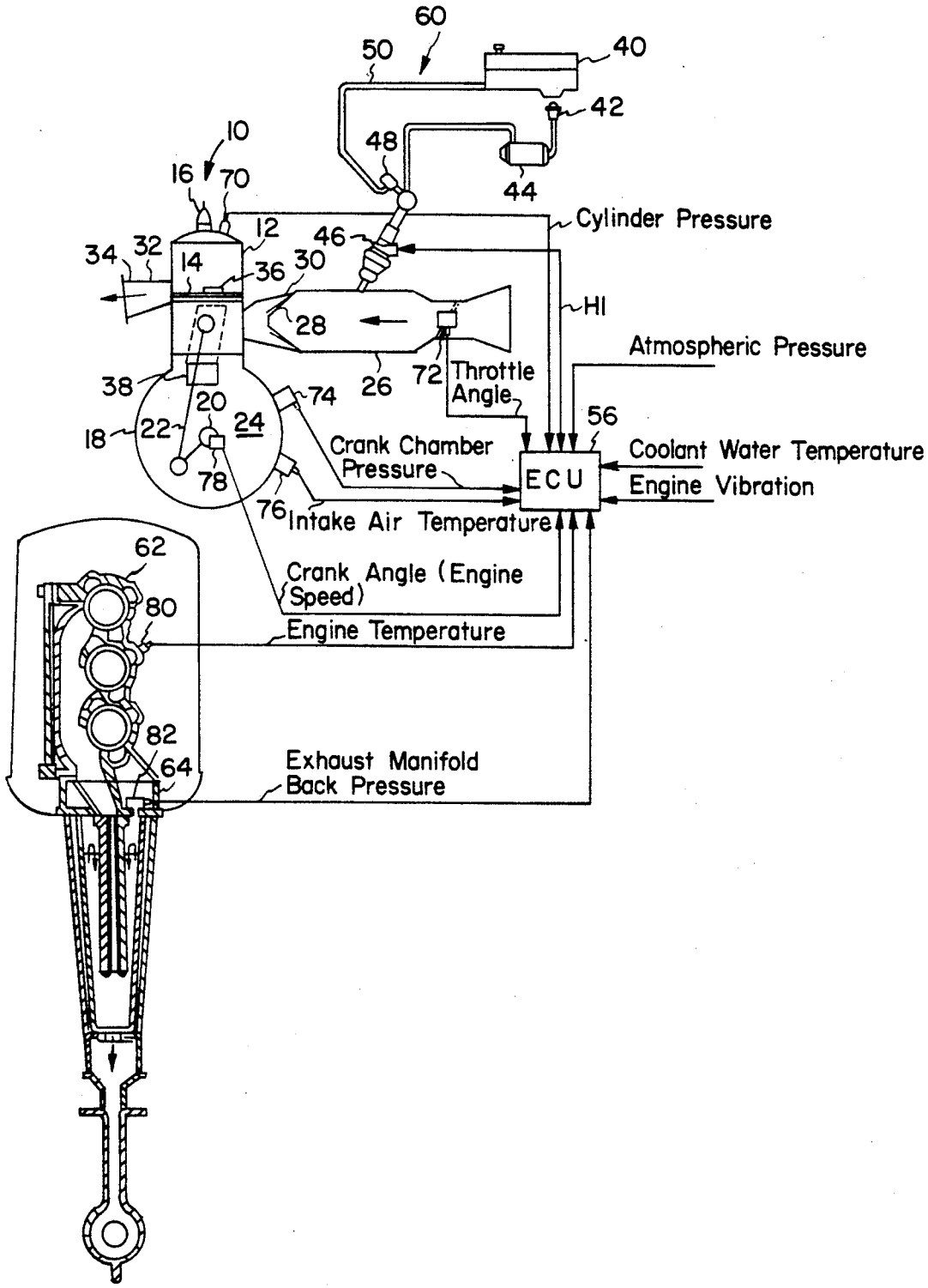
FIG. 2 is a schematic diagram showing structural components of an engine which includes the preferred fuel injection system.

FIG. 2 shows a fuel injected two cycle internal combustion engine 10 which includes the elements of the preferred fuel injection system shown in FIG. 1, with numbering changes as indicated below. As is known, a piston 14 is inside cylinder 12 and is linked to a crankshaft 20, which passes through crank chamber 24 inside crankcase 18, via control rod 22.

Air intake ports 30 are established in the wall surfaces of the above-described cylinders 12 and are connected to air intake lines 26 via reed valves 28. Exhaust ports 32 and scavenging ports 36 are also established in the walls of cylinders 12. The exhaust ports 32 are connected to exhaust pipe 34 and the scavenging ports 36 are linked to the crank chamber 24 by scavenging passages 38. Spark plugs 16 are positioned at the top of the combustion chamber.

Reference number 60 represents the fuel injection system. This fuel injection system is composed of a fuel tank 40, a strainer 42 which removes foreign material from the fuel, an electromagnetic fuel supply pump 44, an injector 46 which injects fuel into the air intake passage, and a pressure regulator 48 which regulates the fuel pressure between fuel pump 44 and injector 46, and which, when the fuel pressure rises above a certain level, returns fuel through pipe 50 to the fuel tank 40.

Reference number 70 denotes a pressure sensor which detects pressure in the combustion chamber, 72 a throttle angle sensor which detects the throttle angle, 74 a pressure sensor which detects pressure inside the crank chamber, 76 an air intake temperature sensor which detects the air intake temperature, 80 an engine temperature sensor which detects the temperature of cylinder body 62, and 82 a pressure sensor (corresponding to the above-mentioned detection means 4) which detects the pressure inside the exhaust manifold 64 of the exhaust system 5. Pressure sensor 82 is placed at an appropriate location in the exhaust system so that its ability to withstand the pressure is not exceeded.

An ECU 56 (which includes means corresponding to the above-mentioned fuel injection control means 3, air intake computation means 2, and correction means 6, as will be described in more detail below) receives detection signals from the above sensors, and in addition receives signals from sensors for detecting atmospheric pressure, coolant water temperature and engine vibration.

The ECU 56 operates according to a program which has been placed in ROM. It uses the various input signals to compute the air intake volume and to determine the amount of fuel to be injected. It then determines the time during which power is fed to the fuel injector 46, based on the amount needed. The electrical power-supply time interval is fed as an injector operating signal H1 to injector 46.

The value for the pressure detection in the exhaust system may then be used either as the basis for the correction of the air intake volume computation, or directly for the determination of fuel injection volume.

Figure 3:
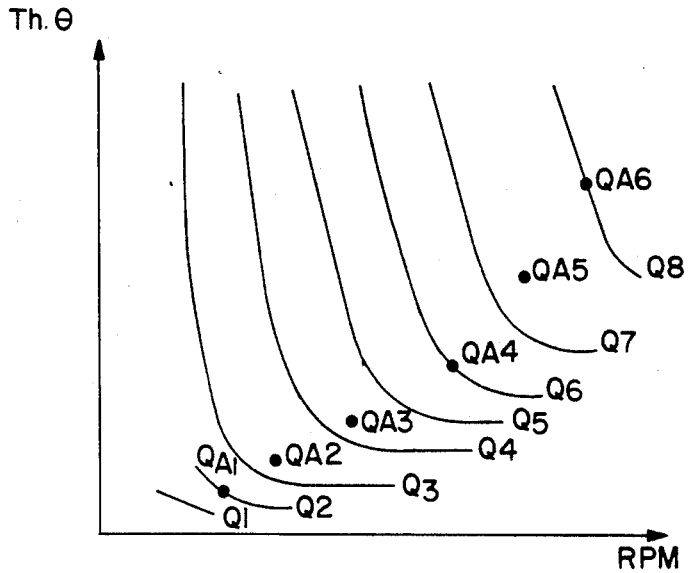
FIG. 3 is a graph of the relationship between engine speed and throttle opening.

The detection of the amount of air intake for internal combustion engine is a primary determinant of their operating condition. For example, if the engine speed (N) and the degree to which the throttle is open (Th. $\theta$) are detected, as shown in FIG. 3, these detection values can be used as the basis for determining the air intake volume, so long as the exhaust is being expelled into the atmosphere. As shown in FIG. 3, when the engine speed and throttle opening are increased, air intake volume also increases, indicating that the air intake volume can be computed based on engine speed and throttle opening.

Figure 4:
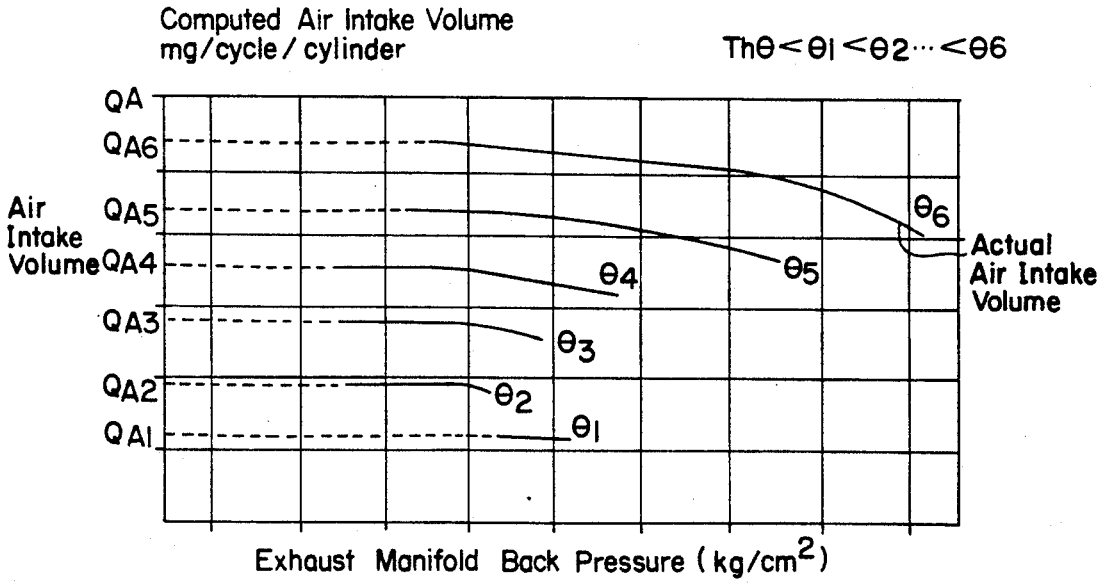
FIG. 4 is a graph of the relationship between exhaust back pressure and air intake volume computation values.

However, with two-cycle outboard engines, for example, changes in speed and load conditions can cause changes in exhaust system back pressure. If, for whatever reason, the back pressure changes, it can build up as shown in FIG. 4, resulting in a decrease in the actual amount of air intake. This causes an error to develop between the air intake computed value ($Q_{A1}$–$Q_{A6}$, see FIG. 3) and the actual value at particular engine speeds (RPM) and throttle openings (Th. $\theta$).

Accordingly, basing fuel injection on the computed air intake volume would make it impossible to achieve the optimum air/fuel ratio, causing lowered output and a performance decline for the internal combustion engine.

However, by making a correction at this point to lower the air intake volume computation based on the detection of the back pressure in the exhaust system, the amount of fuel injected is decreased and an optimum fuel/air mixture is achieved. Conversely, if appropriate, the air volume computation may be increased by such a correction, causing more fuel to be injected and an increase in engine speed, resulting in increased air intake and compensation for lower engine output due to a back pressure increase.

Figure 5:
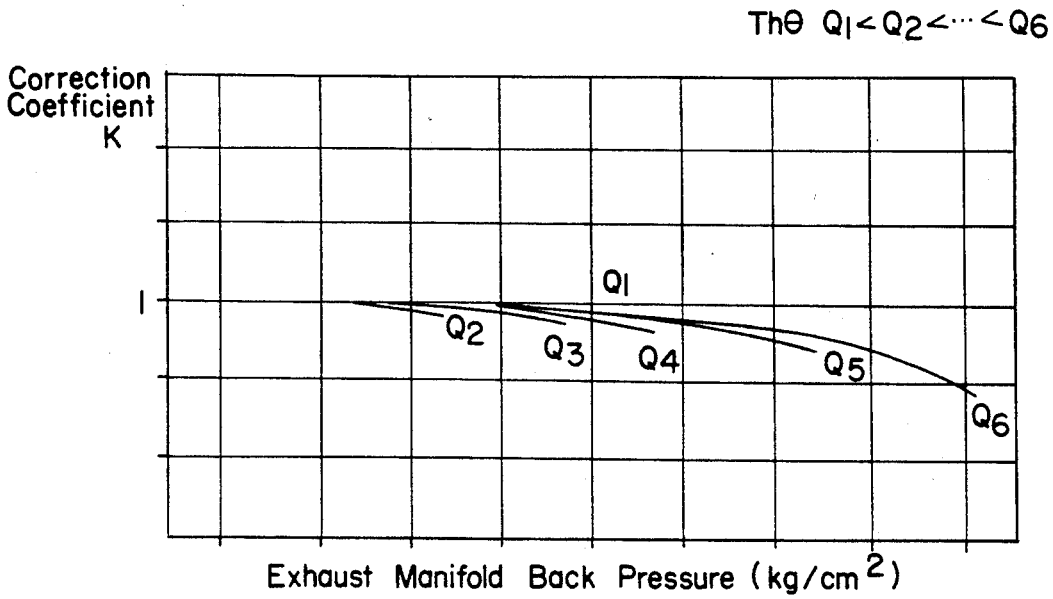
FIG. 5 is a graph of the relationship between exhaust back pressure and a correction coefficient ($<1$).

The correction of the air intake computation can be made, according to one embodiment of the invention, by establishing the relationship between back pressure and the correction as a correction coefficient and multiplying this correction coefficient by the computed amount of air intake. FIG. 5 shows the relationship between the correction coefficient (K) and the back pressure at air-intake volumes $Q_{A1}$ through $Q_{A6}$ at various computation times. As shown in this Figure, when the throttle is fully closed, the air intake volume is at a minimum ($Q_{A1}$) and K is equal to 1. When the throttle is opened, the air intake volume and back pressure increases so that K becomes less than 1. Thus, by multiplying by this correction coefficient, the computed air intake volume is decreased. If the corrected air intake is used as the basis for the computation of the fuel injection, then the amount of fuel injected is also decreased so as to achieve the optimum air/fuel mixture.

Figure 6:
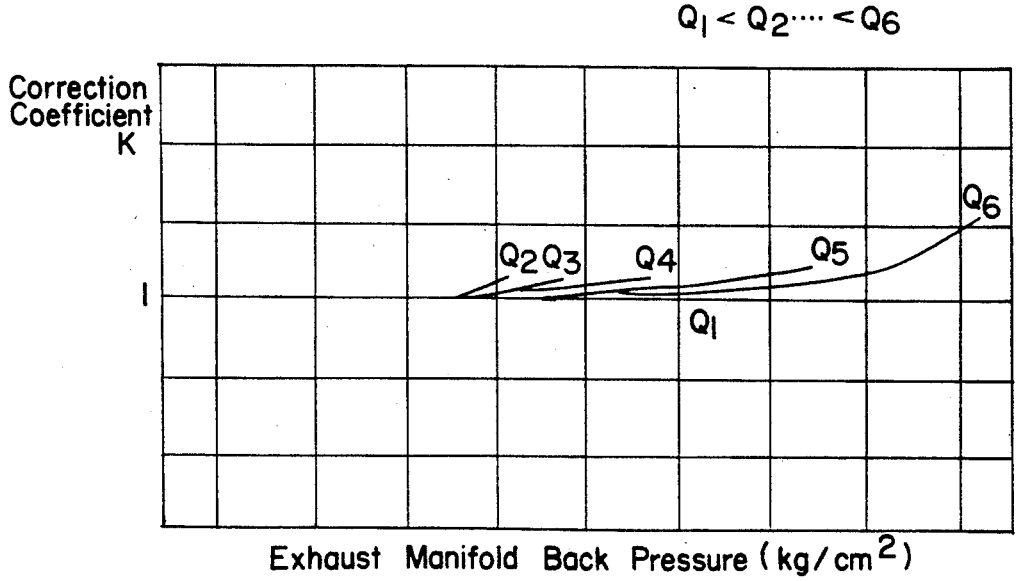
FIG. 6 is a graph of the relationship between exhaust back pressure and a correction coefficient ($>1$).

The correction of the air intake volume computation may be with a correction coefficient $K<1$ as shown in FIG. 5, but it may also be made with a correction coefficient $K>1$ as shown in FIG. 6, which results in increasing the computed value for air intake. If the amount of fuel injection is determined after making this correction to the value computed for air intake, then the fuel injection increases to increase the engine speed, compensating for the lowered output caused by a back pressure increase.

Since there is a 1 to 1 computation for the amount of fuel injection and the computed value for the air intake, approximately the same relationship exists between the computed amount of air intake and the back pressure. Accordingly, similar graphs are obtained in FIGS. 5 and 6 for the relationship between the correction coefficient and the fuel-injection amount. This means that it is not necessary to correct the computed value of air intake to determine the amount of fuel injected. Instead, according to another embodiment of the invention the computed amount of fuel injected may be directly corrected. Further, it is also possible to correct both the computed value for air intake and the computed value for fuel injection.

Figure 7:
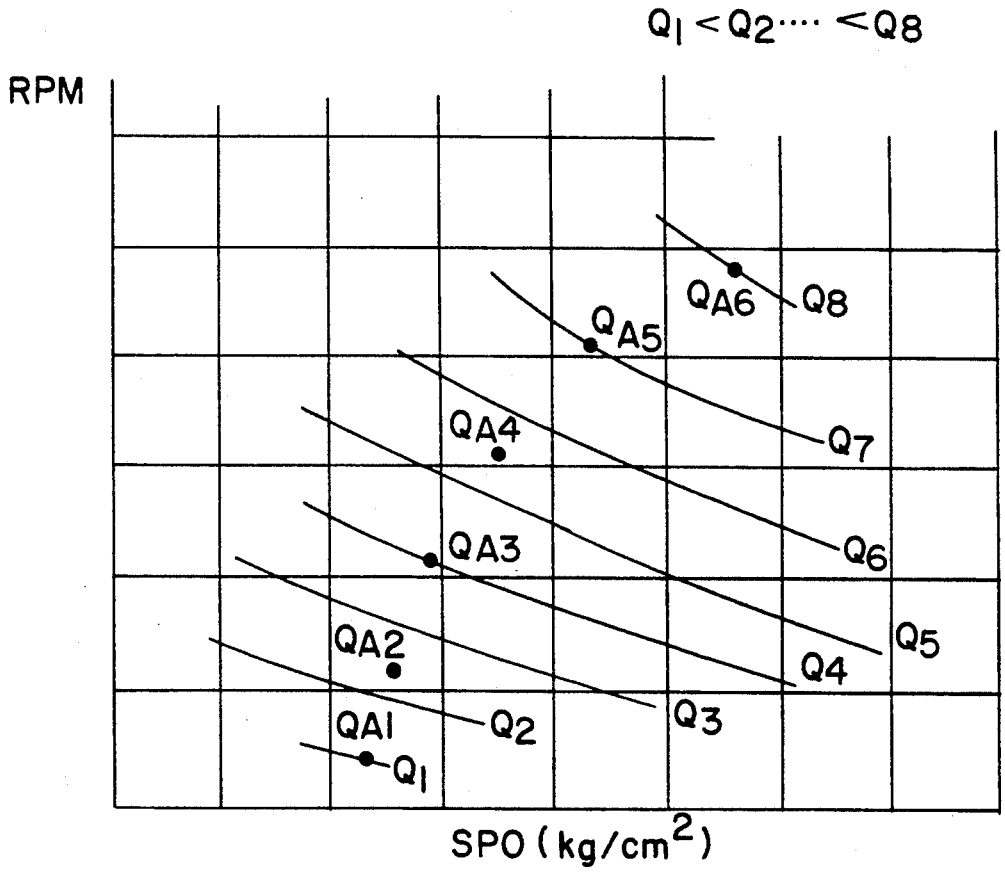
FIG. 7 is a graph of the relationship between scavenging port opening and engine speed.

The amount of air intake (Q) may be computed either as illustrated in FIG. 3, which shows the engine speed and throttle opening method, or as shown in FIG. 7, where the crank chamber pressure just prior to the opening of the scavenging port (called "SPO" below) and the engine speed are determined (this corresponds to the $Q_{A1}$–$Q_{A6}$ in FIG. 7, which corresponds to the same in FIG. 3). In addition, by way of example, the following methods of determining air intake may also be employed, the present invention being advantageously used with any of a variety of different air intake computation methods: using the crank chamber pressure to make the determination, using the changes in the crank chamber pressure, using the difference between the SPO and the scavenging port closing pressure (called "SPC" below) as described in Japan Patent 2-4785), using the determination of the pressure in the air intake, or using a crank chamber pressure and engine speed determination method.

These relationships between engine speed, etc. and air intake can then be set in the ROM memory of the ECU and the air intake volume can be computed according to the various detected values.

Figure 8:
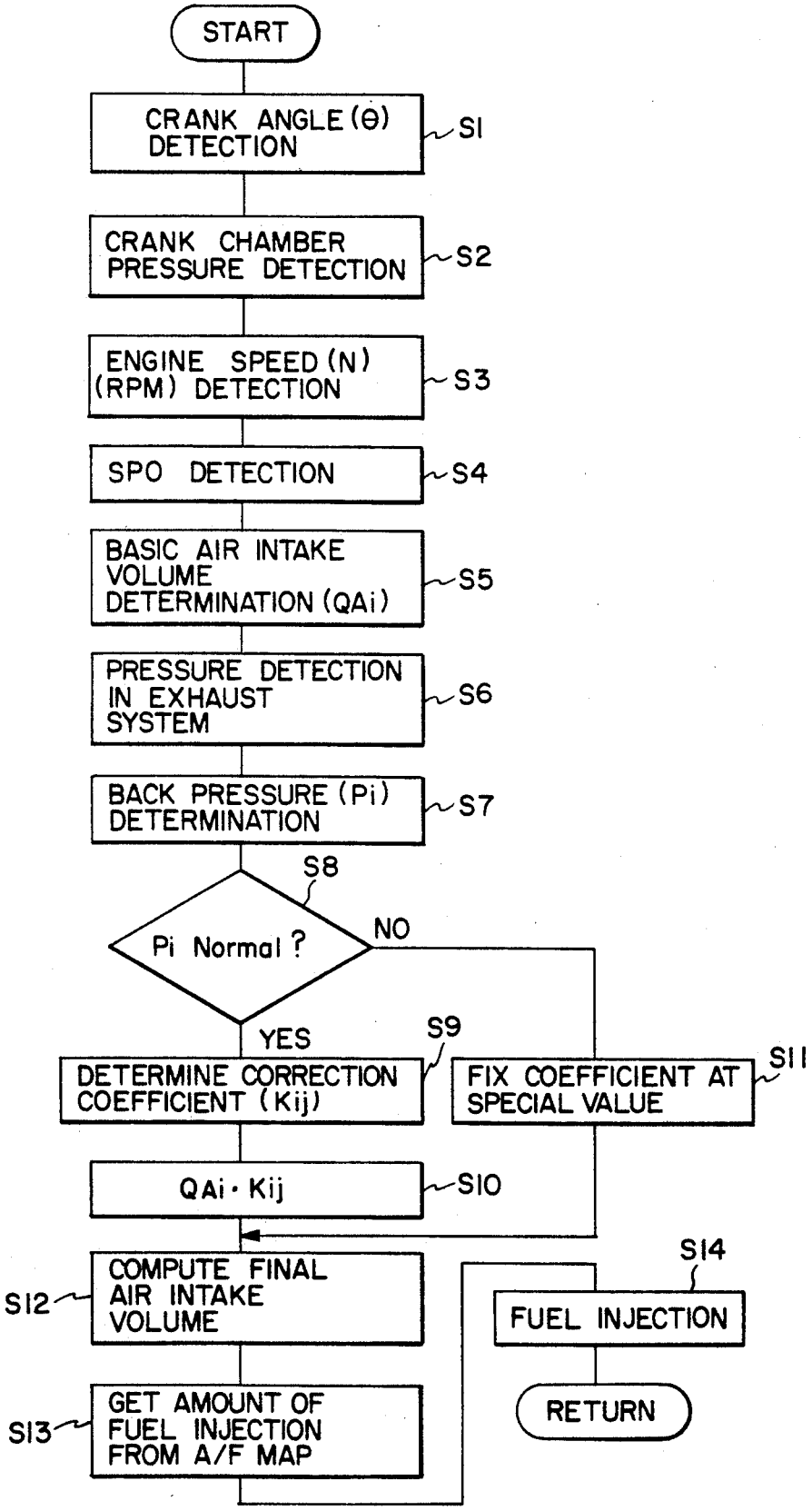
FIG. 8 is a flow chart explaining the operation of the preferred fuel injection system.

Next, a preferred method of operation for the embodiment of FIG. 2 will be explained according to the processing program set in ROM for the ECU 56. This processing is repeated over specific time intervals. In this method, illustrated in FIG. 8, the pressure in the crank chamber just prior to the opening of the scavenging port, and the engine speed, are used to compute the air intake, although any of the other air intake methods described above could be substituted by those skilled in the art. The engine speed/SPO pressure method of air intake computation is described in more detail in Japanese patent application No. Hei 3-190668, filed Jul. 4, 1991, corresponding to U.S. application Ser. No. 907,540, filed Jul. 2, 1992.

First, during step S1, the crank angle is detected when the angle signal is read off the crank angle sensor 78. In step S2, the pressure inside the crank chamber is detected when the signal from pressure sensor 74 is read. In step S3, the engine speed N can be detected by measuring the pulse interval of the crank angle sensor read in S1.

At step S4, the timing SO just prior to the opening of the scavenging port in each cycle is determined by the crank angle detected in S1. At this time, the pressure inside the crank chamber, SPO, and the engine speed (N) are detected and these values are temporarily memorized in the CPU. When the engine is operating at a high speed, a discrepancy develops between the value detected by the crank angle detector and the actual crank angle, and this discrepancy causes a variation in the SPO value. Therefore, it is preferable to make a correction for this discrepancy ahead of time in determining the (SO) timing. It is also desirable to average the SPO crank chamber pressure and engine speed (N) data over several cycles.

Next, moving to S5, the basic air intake volume ($Q_{Ai}$) is computed from the SPO and the engine speed (N). When the back pressure is low, the relationship between the SPO and the engine speed (N) and the basic air intake ($Q_{Ai}$) is as shown in FIG. 7. The relationship is stored ahead of time in the form of a table in the ROM, and the table can thus be used to compute the basic air intake volume.

Next, in step S6, the above-described pressure sensor 82 detects the exhaust manifold pressure, and in step S7, the pressure value (Pi) at the desired crank angle is determined. Here, it is possible to make a correction to the back pressure value based on, for example, the instantaneous value for the crank angle, the median value, the average value, the peak value, the difference between the maximum peak value and the minimum peak value, and so forth.

In step S8, a determination is made as to whether the back pressure value (Pi) is normal or not. In considering whether the back pressure (Pi) is within the required range, a determination must be made as to whether there is a malfunction of the sensor, etc., in sending the back-pressure signals.

Next, at S9, the basic air intake volume ($Q_{Ai}$) and the back pressure value (Pi) have their correction coefficients determined. FIG. 9 shows a three dimensional map of the graph of characteristics shown in FIG. 5 and used for this determination of air intake volume and back pressure correction coefficients. The map is preset in the ROM memory of the ECU 56.

In step S10, the basic air intake volume ($Q_{Ai}$), as determined in S5 above, is multiplied with the correction coefficient (Kij) determined in S9 to compute the corrected air intake volume.

If a determination is made in step S8 that the back pressure value (Pi) is abnormal, however, then steps S9 and S10 are skipped and no reference is made to the three dimensional map shown in FIG. 9 for the correction coefficient. Instead, a pre-established value for the correction coefficient is used. In step S11, the special value correction coefficient is multiplied with the basic air intake volume ($Q_{Ai}$). The special value for the correction coefficient is used in step S11 because, due to the abnormal reading of the back pressure, the correct value cannot be determined. Alternatively, the correction factor of the cycle prior to the abnormal cycle may be substituted for the special value in step S11.

After computing the final corrected air-intake volume in step S12, based on the results of either step S10 or step S11, the correlation between the corrected air intake volume and the amount of fuel injection is determined in step S13 based on a predetermined air to fuel map. Finally, in S14 the electrical power interval to the injector is controlled to inject the required amount of fuel. The power signal H1 to the injector follows a preestablished program in the ECU and injects the fuel in intermittent cycles at the optimal crank angle $\theta$.

As a result of the above, the ECU 56 can make corrections to the computed air intake volume based on the exhaust back-pressure values, allowing the optimal air/fuel ratio to be achieved to improve the performance of fuel injected internal combustion engines. The effects of this invention are especially dramatic with multiple cylinder internal combustion engines, because of the effect of the back pressure on these types of engines.

In the preferred embodiment, only back pressure detection was used to correct the air intake volume, but corrections could also be made for other factors such as exhaust system vibrations, changes in other pressures, etc. The correction coefficient was determined from the relationship between the back pressure and the basic air intake amount, but it could also be determined with respect to the back pressure and engine speed, or with respect to the back pressure and throttle opening.

As described above, the timing of the air intake volume may be based on crank-angle detection just prior to the opening of the scavenging port but, alternatively, as described in Patent Hei 2-4785, the timing could also be determined by the alignment of through-holes in the piston and cylinder, and this time could be set as the detection time for crank chamber pressure detection.

Having just described in detail a specific preferred embodiment of the invention, therefore, it is to be understood that the invention is not to be limited to the above-mentioned embodiment, but rather that the invention should be limited solely by the appended claims.

I claim:

1. A fuel injection system for an internal combustion engine which includes a cylinder, a crank chamber, and an exhaust system, comprising:

air intake computation means for computing a volume of air intake to the crank chamber;

fuel injection control means for controlling an amount of fuel injected into the cylinder based on the computed air intake volume;

detection means for detecting an exhaust system pressure value; and correction means for ensuring that a correct amount of fuel is injected into the cylinder based on the detected pressure value.

2. A fuel injection system as claimed in claim 1, wherein said correction means comprises means for correcting the computed air intake volume based on the detected pressure value.

3. A fuel injection system as claimed in claim 1, wherein said correction means comprises means for directly correcting the fuel injection amount based on the detected pressure value.

4. A fuel injection system as claimed in claim 1, comprising means for connecting said pressure detecting means to an electronic control unit, said correction means including a ROM in said electronic control unit for storing a three-dimensional map of a predetermined relationship between the detected pressure value and a correct air-intake volume at a predetermined computation time.

5. A fuel injection system as claimed in claim 1, wherein said pressure detection means includes a back pressure detector in an exhaust manifold.

6. A fuel injection system as claimed in claim 1, wherein said air intake computation means comprises means for computing the air intake volume based on an engine speed and a throttle opening.

7. A fuel injection system as claimed in claim 1, wherein said air intake computation means comprises means for computing the air intake volume based on a crank chamber pressure just prior to opening of a scavenging port, and an engine speed at the time the crank chamber pressure is determined.

8. A fuel injection system as claimed in claim 7, wherein said correction means comprises means including a ROM for storing a map of a predetermined relationship between an exhaust manifold back pressure detected by said detection means, the crank chamber pressure just prior to a scavenging port opening, and an engine speed.

9. A fuel injection system as claimed in claim 7, wherein said pressure detection means comprises means for detecting said exhaust system pressure value at a predetermined crank angle.

10. A fuel injection system as claimed in claim 1, further comprising means for determining whether the exhaust system pressure value is abnormal, and substituting a pre-established value for the detected pressure value if the value is abnormal.

11. A fuel injection system as claimed in claim 1, further comprising means for determining whether the exhaust system pressure value is abnormal, and if so, substituting a correction factor obtained for a prior engine cycle.

12. A system as claimed in claim 1, wherein said engine is a two-cycle multiple cylinder internal combustion engine.

13. A method of controlling an amount of fuel injected into a cylinder of an internal combustion engine having a crank chamber and an exhaust system, comprising the steps of:

(a) computing a volume of air intake into the crank chamber;

(b) detecting a pressure in the exhaust system; and (c) generating a correction factor for use in determining an amount of fuel to be injected into the cylinder based on the detected pressure and the computed air intake volume.

14. A method as claimed in claim 13, wherein step (c) comprises the steps of applying the correction factor to the computed air intake volume, and using the corrected air intake volume thus obtained to determine the amount of fuel injection.

15. A method as claim in claim 13, wherein step (c) comprises the steps of computing an uncorrected fuel injection amount based on the computed air intake value, and applying the correction factor to the uncorrected fuel injection amount thus obtained to determine a corrected amount of fuel injection.

16. A method as claimed in claim 13, wherein step (b) comprises the step of detecting a back pressure in an exhaust manifold.

17. A method as claimed in claim 13, wherein step (a) comprises the step of computing the air intake volume based on an engine speed and a throttle opening.

18. A method as claimed in claim 13, wherein step (a) comprises the step of computing the air intake volume based on a crank chamber pressure just prior to opening of a scavenging port, and an engine speed at the time the crank chamber pressure is determined.

19. A method as claimed in claim 18, wherein step (a) further comprises the step of detecting said exhaust system pressure value at a predetermined crank angle.

20. A method as claimed in claim 13, further comprising the steps of determining whether the exhaust system pressure value is abnormal, and substituting a preestablished pressure value for the detected pressure value if the value is abnormal.

21. A method as claimed in claim 13, further comprising the step determining whether the exhaust system pressure value is abnormal, and if so, substituting a correction factor obtained for a prior engine cycle.

* * * * *